US007874177B2

(12) United States Patent
Azamy

(10) Patent No.: US 7,874,177 B2
(45) Date of Patent: Jan. 25, 2011

(54) POUCH FOR CARRYING TEMPERATURE-SENSITIVE PRODUCTS

(76) Inventor: Wali Azamy, 1200 Taft St., Irvine, CA (US) 92620

( * ) Notice: Subject to any disclaimer, the term of this patent is extended or adjusted under 35 U.S.C. 154(b) by 0 days.

(21) Appl. No.: 12/040,656

(22) Filed: Feb. 29, 2008

(65) Prior Publication Data

US 2009/0220178 A1 Sep. 3, 2009

(51) Int. Cl.
*F25D 3/08* (2006.01)

(52) U.S. Cl. ..... 62/457.2; 62/457.5; 62/530

(58) Field of Classification Search ..... 62/457.2, 62/457.1, 457.5, 530
See application file for complete search history.

(56) References Cited

U.S. PATENT DOCUMENTS

| | | | | |
|---|---|---|---|---|
| 4,343,158 | A | 8/1982 | Campbell | |
| 4,892,226 | A | 1/1990 | Abtahi | |
| 5,007,250 | A | 4/1991 | Musielak | |
| 5,237,838 | A | 8/1993 | Merritt-Munson | |
| 5,361,603 | A | 11/1994 | Merritt-Munson | |
| 5,490,396 | A | 2/1996 | Morris | |
| 5,533,361 | A | 7/1996 | Halpern | |
| 5,562,228 | A * | 10/1996 | Ericson | 62/457.2 |
| 6,223,551 | B1 | 5/2001 | Mitchell | |
| 6,422,032 | B1 | 7/2002 | Greene | |
| 6,427,475 | B1 | 8/2002 | DeFelice et al. | |
| 6,474,095 | B1 | 11/2002 | Chan | |
| 6,705,108 | B2 | 3/2004 | Defelice et al. | |
| 6,925,834 | B2 * | 8/2005 | Fuchs | 62/457.2 |
| 7,040,115 | B1 * | 5/2006 | Lopez et al. | 62/457.2 |
| 2004/0025528 | A1 * | 2/2004 | Gano, III | 62/371 |

* cited by examiner

*Primary Examiner*—Melvin Jones
(74) *Attorney, Agent, or Firm*—Stetina Brunda Garred & Brucker

(57) ABSTRACT

A pouch for carrying temperature-sensitive products having at least three sides and a bottom that are fixedly attached. The sides and bottom of the pouch form an internal container which may be sized and configured to hold a variety of sizes and shapes of temperature-sensitive products. The pouch may also comprise a releasably-attached top. A thermo-regulable agent is contained within at least one of the sides.

17 Claims, 4 Drawing Sheets

POUCH FOR CARRYING TEMPERATURE-SENSITIVE PRODUCTS

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a thermo-regulable container, and more particularly, to a pouch used to carry temperature-sensitive products.

Thermo-regulable containers are a necessity in many situations. Such containers are often needed in situations requiring the transportation of temperature-sensitive products. Such products may include, but are not limited to, food products such as yogurts, produce, desserts and meats, beverages, medication, and medical-related products such as blood and organs. Thermo-regulable containers allow the transportation of such products away from a traditional thermo-regulable environment such as a refrigerator to wherever the products are needed. Without such thermo-regulable containers, temperature-sensitive products would be in danger of spoiling and are thus otherwise limited in the distance and time the products can remain away from the thermo-regulated environment.

A thermo-regulable container having a resealable top has a seemingly even greater use, as it may better insulate the internal contents of the container to provide for a longer cooling period and thus increase the distance and time the products can remain away from the thermo-regulated environment. In addition, such thermo-regulable containers may better contain the contents within and help prevent their undesired and untimely removal from the container.

Thermo-regulable containers may be used by a variety of consumers, including golfers, boaters, hikers, campers, travelers, medical personnel, promotional representatives, schools, home users, and anyone else desiring an inexpensive and portable solution to preserving temperature-sensitive products outside of a traditional temperature-regulated environment such as a refrigerator. Such containers may also be used in connection with fundraisers and other promotional marketing. For example, such containers may be decorated with the logo or mascot of a school or organization, and sold to students, teachers, staff, parents and donors to raise money for various organizations and causes. Representatives of the medical industry or other industries may use such containers to maintain a proper temperature for sample medicines and other promotional items as they travel throughout their sales area. Boaters, golfers, hikers, campers and travelers also may use such containers to maintain a proper temperature for items placed within, such as beverages, medicines, and food.

Past containers for carrying temperature-sensitive products have had various limitations. For example, a thermos, in general, insulates its internal contents to maintain the temperature of the contents far longer than an ordinary container would. However, thermoses, by their very nature, are generally fragile and lack durability. A simple drop on the ground can destroy the internal vacuum of the thermos causing it to fail in its intended function. In addition, thermoses are generally not flexible and thus limit the types and sizes of products that may be placed within.

Ice chests may also be used as thermo-regulable containers to maintain a cool environment for the products kept within the chest. The ice chest itself insulates the internal contents, and the cool temperature may be provided by the use of ice, ice packs, and/or some other cooling pack to lower the internal temperature of the ice chest. Such chests are disadvantageous as they typically require an external product, such as ice, to maintain the cool temperature. In addition, the chests have rigid walls and thus are not collapsible. Moreover, the use of ice in an ice chest can lead to the ruin of the products within as the ice melts and becomes a liquid.

Ice packs may also be used to transport temperature-sensitive products. However, such ice packs are often used in combination with another container, as the ice pack itself generally only functions as a cooling device, and not as a container. In addition, the ice packs typically are filled with water, which as the ice melts, forms condensation on the ice pack and can cause nearby products to absorb the resulting condensation. Furthermore, many ice packs are not flexible when frozen, limiting the shapes and sizes of products which may be cooled.

Dry ice may also be used to transport temperature-sensitive products. However, dry ice must be used in combination with another container, as the dry ice itself generally only functions as a cooling device, and not as a container. Though longer lasting than an ice pack or ice in general, dry ice is not flexible and may limit the shapes and sizes of products which may be cooled. In addition, dry ice must be carefully handled, as contact with bare skin can be dangerous. Moreover, dry ice can be dangerous in enclosed areas, as it releases heavy carbon dioxide vapor that can cause rapid suffocation.

Accordingly, there is a need in the art for an improved pouch for carrying temperature-sensitive products without requiring an external thermo-regulated agent.

BRIEF SUMMARY

The invention discussed herein addresses the problems identified above as well as other problems identified herein and those that are known in the art. In an aspect of the present invention, a pouch is provided for carrying temperature-sensitive products. The pouch comprises at least three sides. Each of the sides are fixedly attached to two of the other sides. The pouch also comprises a bottom being generally perpendicular to the sides and fixedly attached to the sides. A thermo-regulable agent is contained within at least one of the sides of the pouch.

The pouch may further comprise a top being fixedly attached to at least one of the sides and being releasably attached to at least one other side. The top may be releasably attached to the side by a hook and loop type fastening means, commonly known as Velcro, a zipper, a magnet, a snap, drawstring, or other device or combinations of these devices which allows the top to be releasably attached to the side.

The thermo-regulable agent as embodied in Claim 1 is preferably a gel. In this manner, the thermo-regulable agent may be heated or cooled prior to transporting temperature-sensitive products. The products are then placed within the pouch which acts as a portable thermo-regulable environment to maintain a desired temperature of the products. By way of example, and not by way of limitation, the pouch may be placed in a freezer to cool the thermo-regulable agent. Once the pouch is removed from the freezer, the pouch will then cool the products within it for a finite duration. When no longer needed, the pouch may then be returned to the freezer.

The pouch may be fabricated from a flexible, yet durable material, to allow for the insertion of a variety of products. The pouch may be collapsible to allow for ease of storage. The pouch may also be sized and configured to hold a variety of sizes and shapes of products, such as beverage containers, food products such as yogurt, produce, desserts and meats, medicines, medical products such as blood and organs, or any other temperature-sensitive products that may require transportation. The pouch may also be sized and configured for a single product, such as a beverage container. The pouch may also be sized and configured such that the pouch may be insertable into a larger container.

It is an object of the present invention to provide for a pouch that may carry a variety of temperature-sensitive products without the need an external thermo-regulable agent, such as an ice pack.

Other features and advantages are inherent in the invention claimed and disclosed or will become apparent to those skilled in the art from the following detailed description and its accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

In the following description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

Referring now to FIGS. 1-8, a pouch 102 is shown comprising four sides 104, although various number of sides 104 may be used. The pouch 102 also comprises a bottom 106, which together with the sides 104, provides an internal container 116 for carrying products. Preferably, the bottom 106 is generally perpendicular to sides 104.

Figure 6:
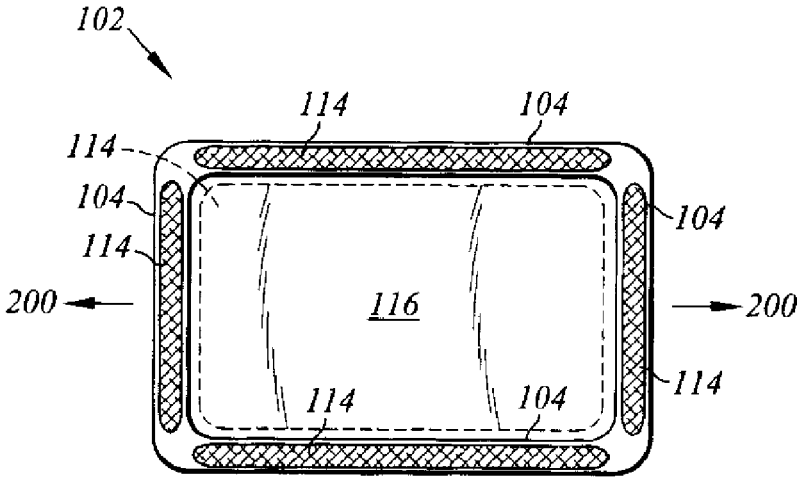
FIG. 6 is a sectional view of the pouch shown in FIG. 3 as taken in the direction of arrows 200-200 and having a thermo-regulable agent contained within two of its sides.
Figure 7:
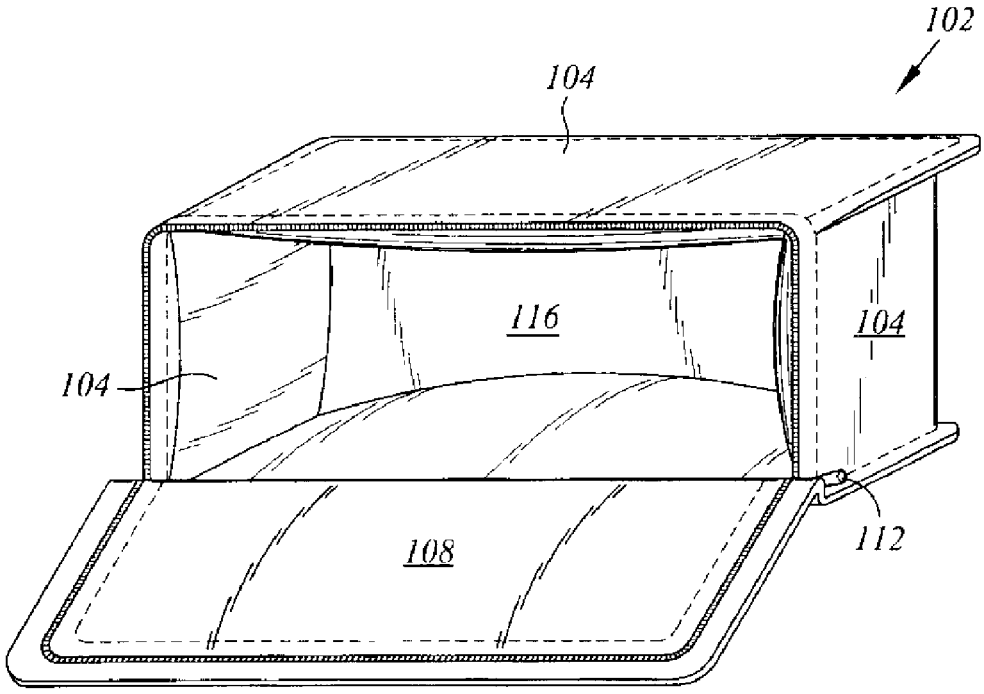
FIGS. 7-8 are perspective views of the pouch in FIG. 5 with the top open allowing the insertion or removal of products.
Figure 8:
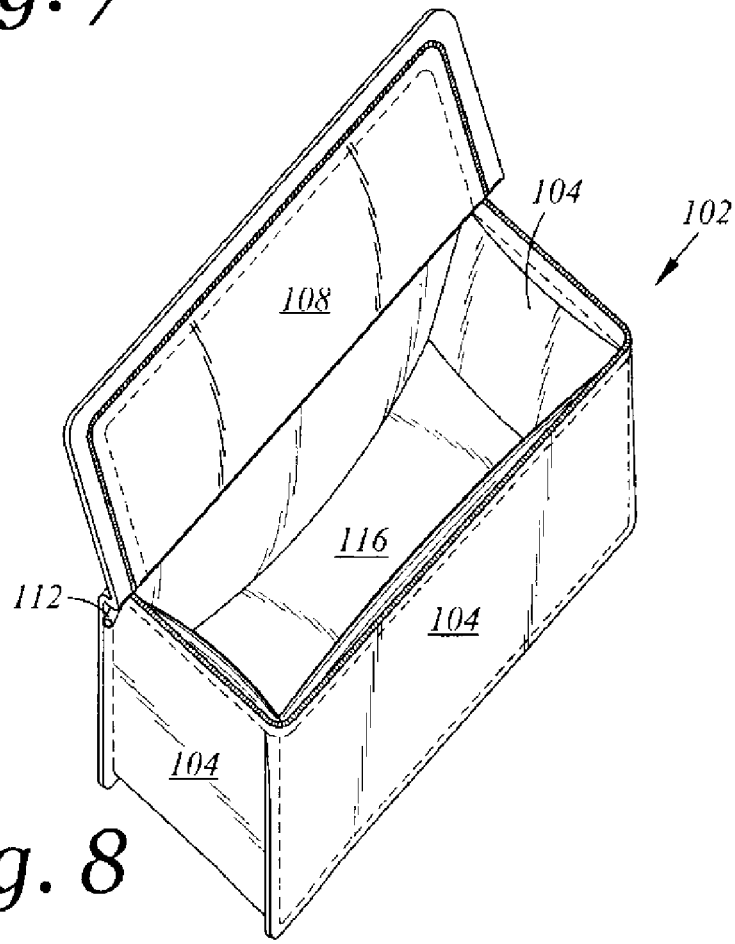

A thermo-regulable agent 114, shown in FIG. 6, is encompassed within at least one of the sides 104, and preferably, four of the sides 104, as well as top 108 and bottom 106. The thermo-regulable agent 114 is preferably a gel, but may also be a liquid, solid or combinations thereof. In this manner, the thermo-regulable agent 114 may be heated or cooled prior to transporting temperature-sensitive products, which thus enables the agent 114 to heat or cool the products and enable them to be transported. For example, and not by way of limitation, the thermo-regulable agent 114 is such that when placed in a cool environment, such as a freezer, the temperature of the thermo-regulable agent 114 is decreased. Once the pouch 102 is removed from the freezer, the thermo-regulable agent 114 present in at least one of the sides 104 of the pouch 102 enables the pouch 102 to keep cool for a finite period the products located within the internal container 116 of the pouch 102.

Figure 1:
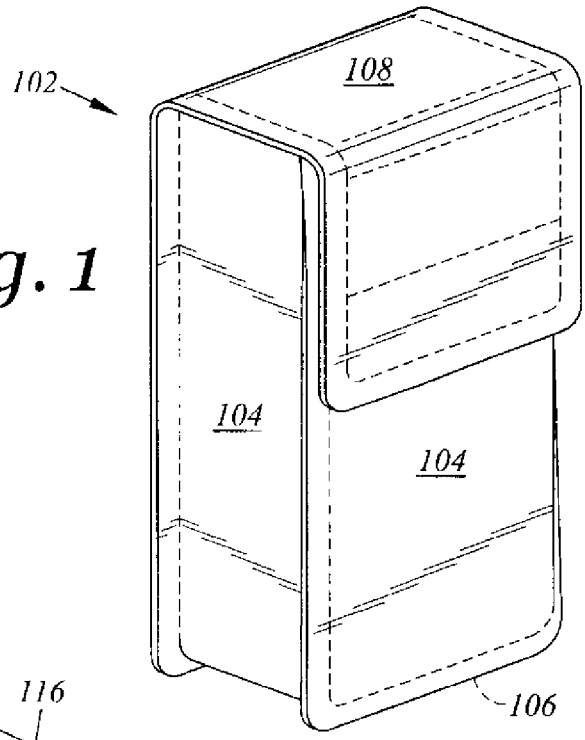
FIG. 1 is a perspective view of a pouch with the top sealed to prevent the removal of the internal contents of the pouch.
Figure 2:
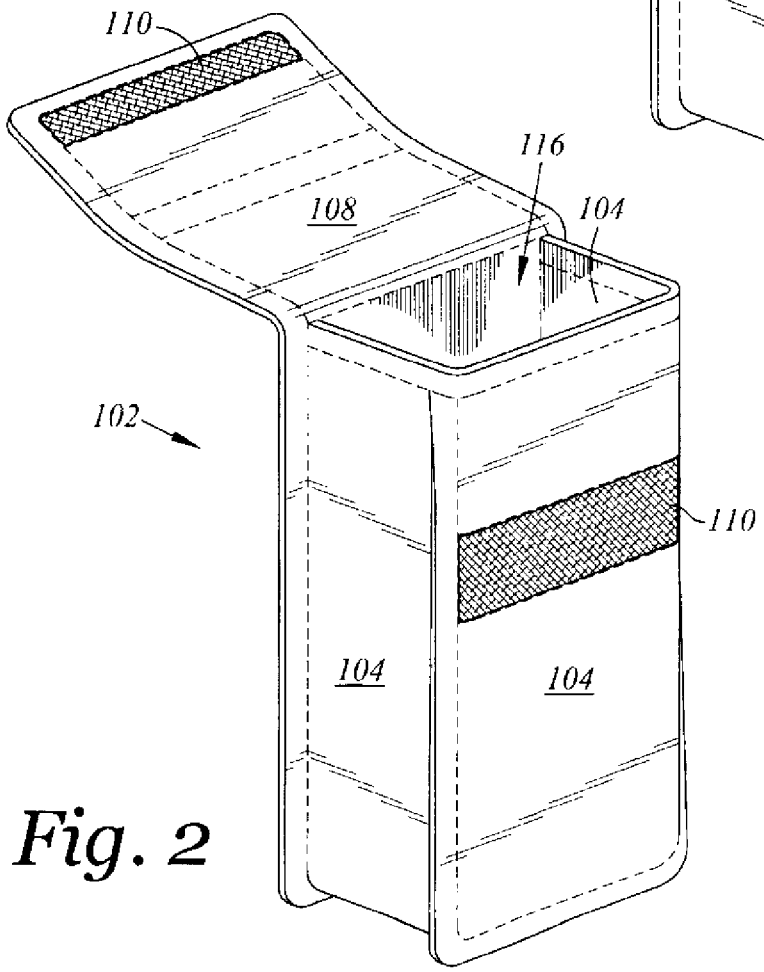
FIGS. 2-4 are perspective views of the pouch with the top open allowing the insertion or removal of products.
Figure 3:
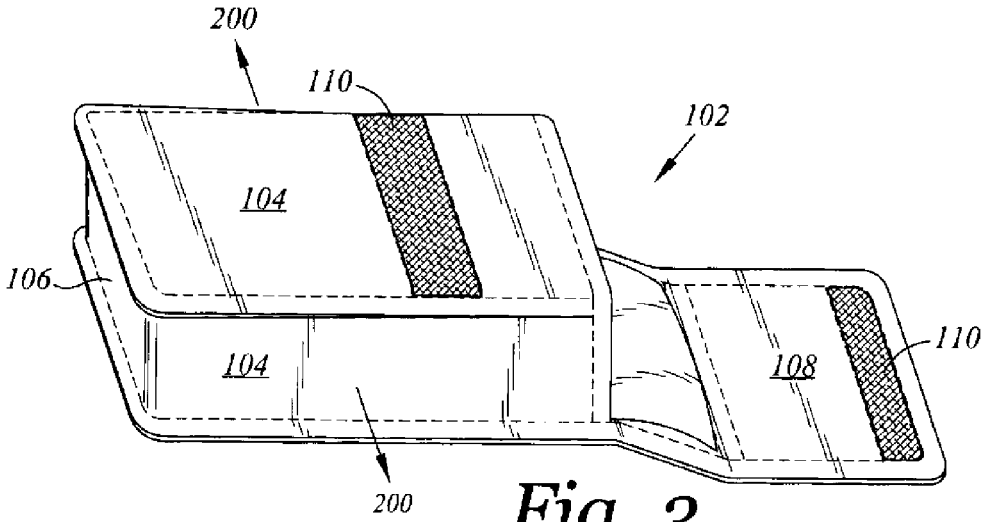

Referring to FIGS. 1, 2 and 3, the pouch 102 may comprise a top 108. The top 108 is preferably fixedly attached to a side 104 of the pouch 102, and releasably attached to a generally opposite side 104 of the pouch 102. Preferably, a resealable top 108 is employed to allow certain items within the internal container 116 of the pouch 102 to be removed, while the remaining items in the internal container 116 may still be cooled. Preferably a hook and loop type fastening means 110, commonly known as Velcro, is used to releasably attach the top 108, though any resealable fasteners may be used, such as a zipper 112, a snap, a magnet, drawstring or other fastener or combinations of these fasteners, without departing from the scope of the present invention. Non-resealable fasteners may also be used, such as glue, staples, pins, or other fasteners and/or adhesives or combinations of these fasteners, without departing from the scope of the present invention.

Figure 4:
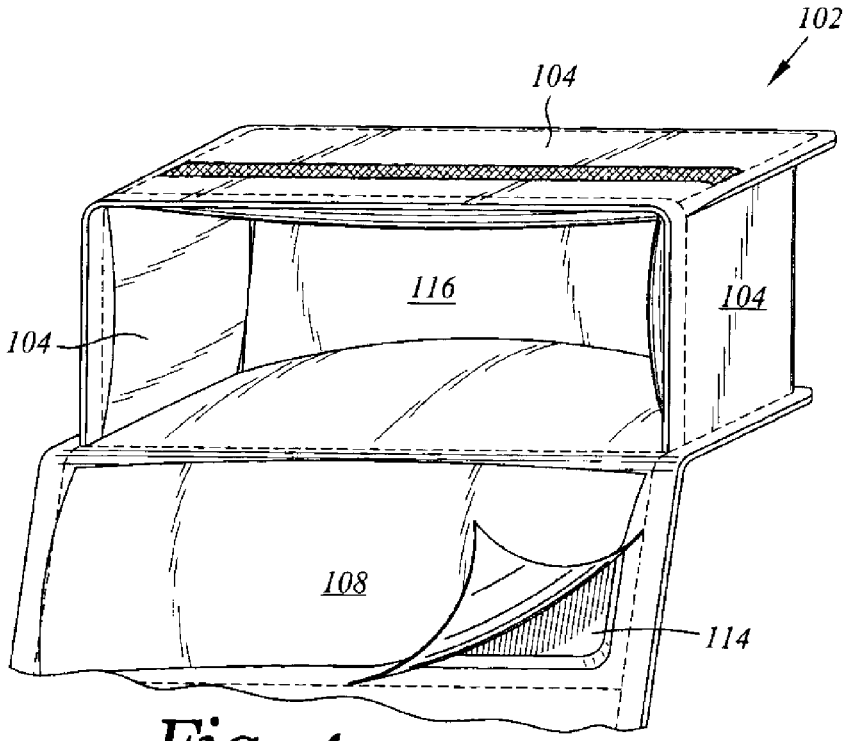
Figure 5:
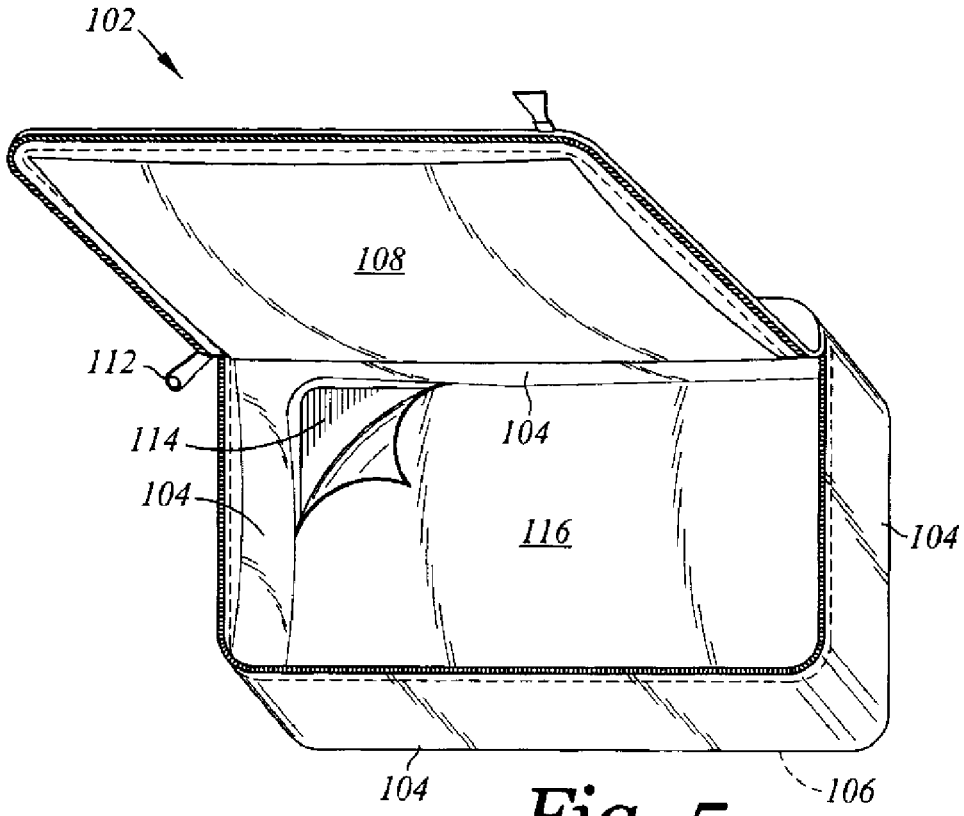
FIG. 5 is a perspective view of the pouch having a zipper used to close the top.

Referring to FIGS. 4-8, the sides 104, bottom 106, and top 108 of the pouch 102 are preferably flexible, and allow the pouch 102 to collapse for storage. The sides 104 are such that they may contain the thermal-regulable agent 114. Top 108 and bottom 106 may also contain the thermal-regulable agent 114, to allow products within the pouch 102 to be warmed or cooled about all sides, top and bottom. In the presently preferred embodiment the thermal-regulable agent 114 is fixedly contained within the sides, top and/or bottom of the pouch 102. FIGS. 4-6 show various views of the preformed embodiment having a gel pack 114 fixedly contained in the top 108, bottom, and/or sides 104 of the pouch 102. However, it is anticipated that the sides, top and/or bottom may be constructed to allow removal and replacement of the thermal-regulable agent 114, e.g. to allow a first set of packets including thermal-regulable agent 114 to be chilled while another set is in use within pouch 102.

The sides 104 also are preferably fashioned to allow the radiation and/or conduction of the temperature of the thermo-regulable agent 114 into the internal container 116 of the pouch 102. The sides 104, bottom 106, and top 108 of the pouch 102 may be fashioned from plastic, polycarbonate, nylon, vinyl, mylar or other materials or combinations of these materials without departing from the scope of the present invention. Insulating materials may also be disposed within the exterior side walls, top wall, and/or bottom wall of pouch 102, outboard of regulable agent 114, to enhance the cooling or warming properties of the pouch 102, and to provide additional structural rigidity to the pouch.

As will be recognized by one skilled in the art, the pouch 102 may be sized and configured to accommodate products of various sizes and shapes. The pouch 102 may also be sized and configured to accommodate a single product such as a beverage container. The pouch 102 may also be sized and configured to be insertable into another container.

The above description is given by way of example, and not limitation. Given the above disclosure, one skilled in the art could devise variations that are within the scope and spirit of the invention disclosed herein, including various ways of containing and cooling temperature-sensitive products. Further, the various features of the embodiments disclosed herein can be used alone, or in varying combinations with each other and are not intended to be limited to the specific combinations described herein. Thus, the scope of the claims is not to be limited by the illustrated embodiments.

What is claimed is:

1. A pouch for carrying temperature-sensitive products, the pouch comprising:

a) four sides, each of the sides being fixedly attached to two other sides;

b) a bottom being generally perpendicular to the sides and attached to the sides;

c) a top being generally perpendicular to the sides and attached to at least one of the sides, the top being fixedly attached to at least one side, and releasably attached to at least one other side by a hook and loop type fastener; and d) a thermo-regulable agent being fixedly contained within each of the sides the top and the bottom;

e) the sides, bottom and top each being formed of flexible material, joined to form a collapsible pouch.

2. The pouch of claim 1 wherein the thermo-regulable agent is a gel.

3. The pouch of claim 1 wherein the thermo-regulable agent is fixedly contained within the bottom and the top of the pouch.

4. The pouch of claim 1 wherein the thermo-regulable agent is fixedly contained within four sides of the pouch.

5. The pouch of claim 1 wherein the thermo-regulable agent is fixedly contained within the four sides, the top and the bottom of the pouch.

6. The pouch of claim 1 wherein the sides of the pouch are flexible to accommodate insertion of different shaped products into the pouch.

7. The pouch of claim 1 wherein the pouch is collapsible.

8. A pouch for carrying temperature-sensitive products, the pouch comprising:

a) a first side wall, a second side wall, a back wall and a front wall, the first and second side walls being generally parallel to and opposite of each other, the back and front walls being generally parallel to and opposite of each other;

b) a bottom being generally perpendicular to the walls and fixedly attached to the walls;

c) a top being fixedly attached to at least one wall, the top further being releasably attached to at least one wall; and d) a thermo-regulable gel being fixedly contained within the first and second side walls, the front wall and the back wall and the top and bottom of the pouch;

e) the sides, bottom and top each being formed of flexible material, joined to form a collapsible pouch.

9. The pouch of claim 8 wherein the top is releasably attached to at least one wall by a hook and loop type fastener.

10. The pouch of claim 8 wherein the top is releasably attached to three of the walls by a zipper.

11. The pouch of claim 8 wherein the walls are flexible to accommodate insertion of different shaped products into the pouch.

12. The pouch of claim 1 wherein the thermo-regulable agent is substantially co-extensive with each of the sides, the top and the bottom.

13. The pouch of claim 12 where in the thermo-regulable agent extends uninterrupted along each of the sides, the top and the bottom.

14. The pouch of claim 13 wherein each of the at least two sides comprises an exterior side wall, an interior side wall and thermo-regulable agent, the thermo-regulable material being disposed immediately adjacent the exterior side wall, and the interior side wall.

15. The pouch of claim 8 wherein the thermo-regulable agent is substantially co-extensive with each of the side walls, the top and the bottom.

16. The pouch of claim 15 wherein the thermo-regulable agent extends uninterrupted along each of the side walls, the top and the bottom.

17. The pouch of claim 16 wherein each of the at least two sides comprises an exterior side wall, a thermo-regulable agent disposed immediately adjacent the exterior side wall, and the interior side wall disposed immediately adjacent the thermo-regulable agent.

* * * * *